US007349647B2

(12) United States Patent
Sugiyama

(10) Patent No.: US 7,349,647 B2
(45) Date of Patent: Mar. 25, 2008

(54) IMAGE FORMING APPARATUS

(75) Inventor: Hideaki Sugiyama, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 304 days.

(21) Appl. No.: 11/215,073

(22) Filed: Aug. 31, 2005

(65) Prior Publication Data

US 2007/0048003 A1 Mar. 1, 2007

(51) Int. Cl.
*G03G 15/00* (2006.01)

(52) U.S. Cl. ..... 399/107; 399/110; 399/405

(58) Field of Classification Search ..... 399/107, 399/110, 405, 361; 347/108
See application file for complete search history.

(56) References Cited

U.S. PATENT DOCUMENTS

2002/0064393 A1* 5/2002 Akimoto ..... 399/107
2005/0031371 A1* 2/2005 Kaida et al. ..... 399/110

FOREIGN PATENT DOCUMENTS

JP 4-147276 A 5/1992
JP 4-298454 A 10/1992

* cited by examiner

*Primary Examiner*—David M. Gray
*Assistant Examiner*—Ryan D. Walsh
(74) *Attorney, Agent, or Firm*—Foley & Lardner LLP

(57) ABSTRACT

In an image forming apparatus of the present invention, although an upper cover is rotated when a body frame is opened, a free end of a base for fixing a paper receiving tray makes contact with a side of the frame, thus an inclination angle of the paper receiving tray in link motion with rotation of the upper cover is controlled, and the paper receiving tray is inclined at time of rotation of the cover member, and sheets of paper are prevented from falling.

6 Claims, 3 Drawing Sheets

IMAGE FORMING APPARATUS

FIELD OF THE INVENTION

The present invention relates to an image forming apparatus used for a copier and a printer having a paper receiving tray for loading a sheet of paper after forming a toner image on the side of the body frame.

DESCRIPTION OF THE BACKGROUND

In image forming apparatuses such as an electro-photographic copier, a facsimile, and a printer, there is an apparatus available, for maintenance such as parts exchange, cleaning, and recovery of paper jamming, for rotating a cover on the top using a cover switching support point formed on the side of the body frame as a fulcrum and opening an image forming unit or the conveying path of sheets of paper. On the other hand, among various image forming apparatuses, there is an apparatus available having a paper receiving tray for loading sheets of paper whereon images are formed which is arranged on the side of the body frame.

However, in the image forming apparatus wherein the paper receiving tray is installed on the side of the body frame, when the top cover is opened, the side of the body frame is rotated, so that the paper receiving tray is inclined in link motor with the body frame. When the paper receiving tray is inclined like this, if a sheet of paper with an image formed is loaded on the paper receiving tray, the sheet of paper on the paper receiving tray falls.

Therefore, conventionally, before opening the cover at time of maintenance, a sheet of paper to be loaded on the paper receiving tray is removed once and after end of maintenance, the removed sheet of paper is returned again onto the paper receiving tray.

However, the sheet of paper moving operation aforementioned in correspondence with the maintenance operation causes staining to sheets of paper and requires a great deal of time and it is necessary to reserve a space for keeping sheets of paper taken out from the paper receiving tray free of staining during the maintenance operation.

Therefore, an image forming apparatus for preventing sheets of paper on the paper receiving tray arranged on the side of the body frame from falling though the cover opening operation of the body frame is performed, reducing the maintenance operation, and preventing the sheets of paper form staining is desired.

SUMMARY OF THE INVENTION

Therefore, the effect of the present invention, when rotating the cover member and opening or closing the body frame, regardless of the rotational angle of the cover member, controls the inclination angle of the paper receiving tray and prevents the paper receiving tray from falling of sheets of paper. By doing this, the present invention provides an image forming apparatus for reducing the operation at time of maintenance, preventing sheets of paper from staining, and reducing the space for maintenance.

To accomplish the above effect, according to the embodiments of the present invention, there is provided an image forming apparatus comprising: a body frame having an image forming unit; a cover member, which is openable and closable, provided on the body frame by rotating; a paper receiving tray provided in the neighborhood of a side of the body frame, when the cover member is closed, so as to load a recording member which is formed with an image by the image forming unit and is discharged from the body frame; and a stopper member to fix the paper receiving tray, attaching slidably a mounting end to the cover member, making a free end thereof contact with the side of the body frame when the cover member is opened, and control an inclination angle of the paper receiving tray.

DETAILED DESCRIPTION OF THE INVENTION

Hereinafter, with reference to the accompanying drawings, the first embodiment of the present invention will be explained in detail.

Figure 1:
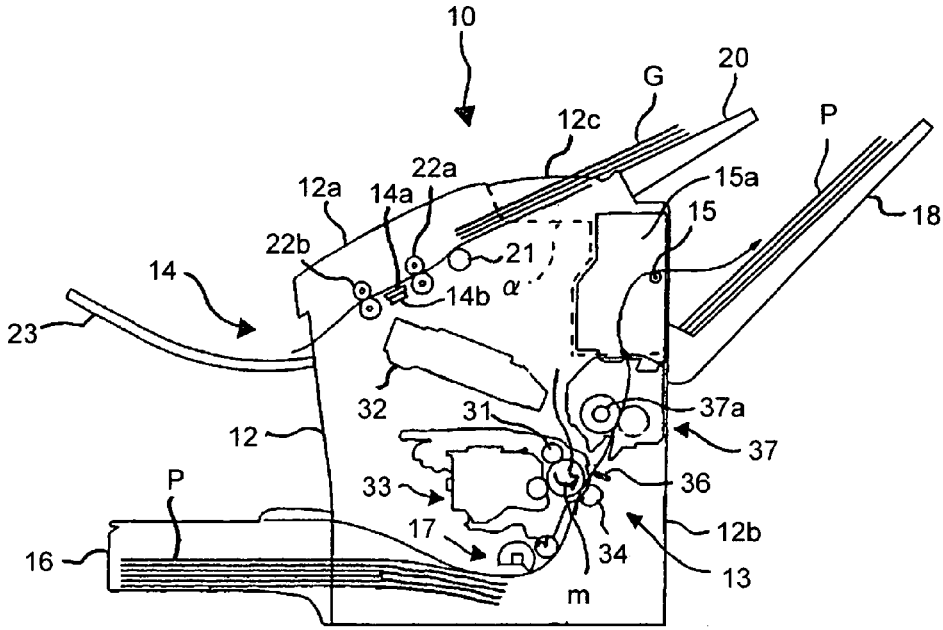
FIG. 1 is a schematic block diagram showing the copier of the first embodiment of the present invention.
Figure 2:
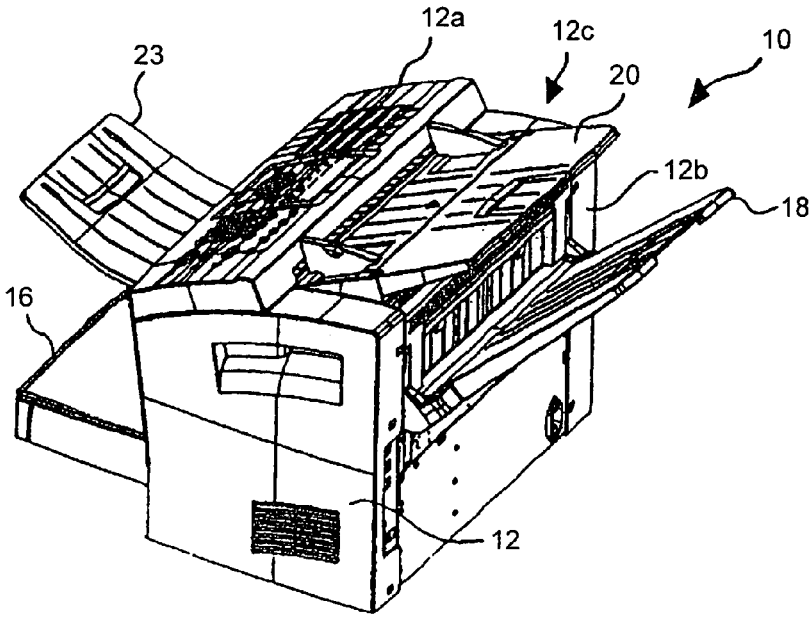
FIG. 2 is a schematic perspective view showing the copier of the first embodiment of the present invention.

FIG. 1 is a schematic block diagram showing copier 10 which is the image forming apparatus of the first embodiment of the present invention. FIG. 2 is a schematic perspective view of copier 10. Copier 10 has image forming unit 13 in body frame 12. Further, on the upper part of image forming unit 13 in body frame 12, copier 10 has a scanner 14 for reading document G passing through on contact glass 14*a*. Further, on the top of body frame 12, control panel 12*a* is arranged. On the lower part of body frame 12, paper supply cassette 16 for storing sheets of paper P which are recording members and paper supply mechanism 17 for taking out sheets of paper P from paper supply cassette 16 and supplying them to image forming unit 13 are installed. On frame side 12*b* on the opposite side of the side of body frame 12 where paper supply cassette 16 is attached, paper receiving tray 18 for loading sheet of paper P which is formed with a toner image by image forming unit 13 and is discharged by paper discharge rollers 15 is installed.

Scanner 14, while document G taken out from document table 20 by auto document feeder (ADF) roller 21 is conveyed toward document tray 23 by first and second feed rollers 22*a* and 22*b*, reads the document image by reading unit 14*b* at the position of contact glass 14*a*.

Image forming unit 13, around photosensitive drum 30, has charging roller 31 for uniformly charging photosensitive drum 30 according to rotation of photosensitive drum 30 in the direction of arrow m, laser exposure unit 32 for forming a latent image on charged photosensitive drum 30 on the basis of image data from scanner 6, transfer roller 34 to which an image transfer bias is applied, and needle-shaped discharger 36. On the downstream side of sheets of paper P after passing transfer roller 34 in the conveying direction, fixing roller unit 37 composing a part of image forming unit 2 and having built-in heater lamp 37*a* is installed. On the downstream side of fixing roller unit 37, paper discharge roller 15 for discharging sheets of paper P after fixing to paper receiving tray 18 is installed.

Next, body frame 12 and paper receiving tray 18 will be described in detail. Upper cover 12*c* neighboring control panel 12*a* on the top of body frame 12 rotates at time of maintenance such as exchange and cleaning of parts of image forming unit 13 and scanner 14 in body frame 12 and recovery of paper jamming and opens or closes the inside of body frame 12. Upper cover 12*c* rotates integrally with document table 20 of scanner 14, paper discharge roller 15 in body frame 12, and the recording paper conveying path with a boundary of dotted line ∂. Upper cover 12*c* rotates at a fulcrum of switching support point 40 on frame side 12*b* shown in FIG. 3. Between body frame 12 and upper cover 12*c*, chain 38 which is a cover control member for controlling the rotational angle of upper cover 12*c* is stretched.

Figure 4:
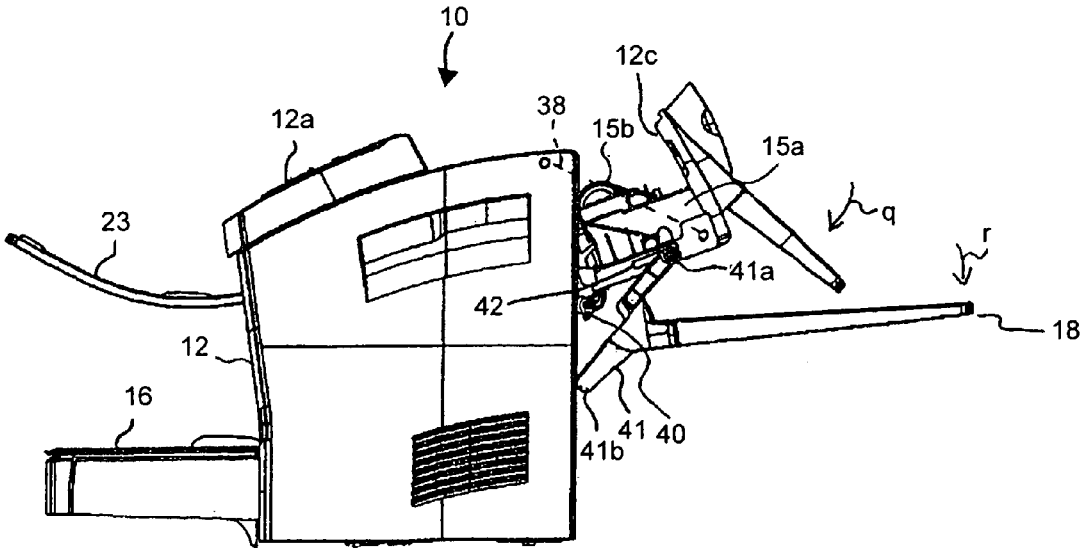
FIG. 4 is a schematic side view showing the copier, when the upper cover is opened, of the first embodiment of the present invention.

Paper receiving tray 18 is fixed to space 41 which is a stopper member. Projection pin 41*a* installed at the mounting end of space 41, as shown in FIG. 4, is slidably attached to slit-shaped tray mounting portion 42 of upper cover 12*c*. Free end 41*b* of space 41, when upper cover 12*c* is opened, makes contact with frame side 12*b* and controls the inclination angle of paper receiving tray 18 regardless of the rotational angle of upper cover 12*c*. Further, numeral 15*b* indicates a linkage gear for connecting paper discharge roller 15 to the body side to drive it.

Next, the operation of the invention will be described. For example, when forming a document image read by scanner 14, firstly, document G is loaded on document table 20 and various image forming conditions are set by control panel 12*a*. When the image forming process is started, in scanner 14, document G on document table 20 is supplied by ADF roller 21 in the direction of arrow n and while it is conveyed by first and second feed rollers 22*a* and 22*b*, the document image is read by reading unit 14*b* at the position of contact glass 14*a*. Hereafter, document G is discharged to document tray 23.

In image forming unit 13, photosensitive drum 30 is rotated in the direction of arrow m and photosensitive drum 30 is uniformly charged by charging roller 31 and then is irradiated with a laser beam according to the document image by laser exposure unit 32, and an electrostatic latent image is formed. Next, photosensitive drum 30 is developed by developing device 33 and a toner image is formed.

During this period, in paper supply cassette unit 16, in synchronization with the toner image on photosensitive drum 30, sheet of paper P is taken out by paper supply mechanism 17 and is supplied toward photosensitive drum 30. Next, sheet of paper P is transferred with the toner image formed on photosensitive drum 30 by transfer roller 32, is further discharged by discharger 36, and is separated from photosensitive drum 30. Hereafter, sheet of paper P, after the toner image is heated, pressurized, and fixed by fixing roller unit 37, is discharged to paper receiving tray 18 by paper discharge roller 15. Hereafter, the similar image forming process is repeated until necessary image forming is completed.

While image forming is performed like this, if document G or sheet of paper P is jammed or maintenance such as parts exchange is required, upper cover 12*c* is rotated in the direction of arrow q at a fulcrum of switching support point 40 and body frame 12 is opened.

By doing this, as shown in FIG. 1, the part shown by dotted line ∂ in body frame 12 is opened.

On the other hand, tray mounting portion 42 is rotated at a fulcrum of switching support point 40 in correspondence to the rotation of upper cover 12*c*, so that paper receiving tray 18 attached to tray mounting portion 42 via base 41 is rotated in the direction of arrow r. However, when free end 41*b* of base 41 makes contact with frame side 12*b* while paper receiving tray 18 is rotated in the direction of arrow r, paper receiving tray 18 is stopped rotation and the inclination angle is controlled. Hereafter, upper cover 12*c* is further rotated in the direction of arrow q until chain 38 is stretched. During this period, projection pin 41*a* of base 41 slides in the direction of arrow s along tray mounting portion 42.

When chain 38 is stretched and upper cover 12*c* is stopped rotation, maintenance such as recovery of paper jamming is performed. At this time, as shown in FIG. 4, upper cover 12*c* is rotated in the direction of arrow q at a sufficient angle to open body frame 12. On the other hand, paper receiving tray 18, since free end 41*b* of base 41 makes contact with frame side 12*b*, can control inclination angle β to 90° or smaller. Therefore, although upper cover 12*c* is opened, sheet of paper P on paper receiving tray 18 can be prevented from falling.

Figure 3:
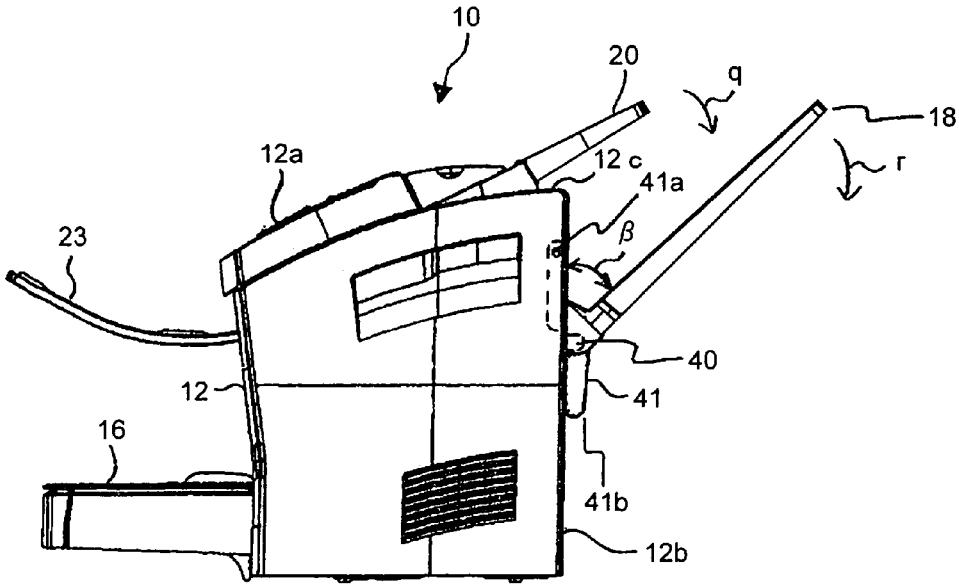
FIG. 3 is a schematic side view showing the copier, when the upper cover is closed, of the first embodiment of the present invention.

After end of the maintenance, upper cover 12*c* is closed, and paper receiving tray 18 is returned to the position shown in FIG. 3, and the apparatus waits for the next image forming process.

According to the first embodiment, upper cover 12*c* is rotated at a large angle, thus the body frame is opened sufficiently and satisfactory maintainability can be obtained. On the other hand, although upper cover 12*c* rotates, free end 41*b* of base 41 makes contact with frame side 12*b*, thus paper receiving tray 18 can be stopped rotation. Therefore, the inclination angle of paper receiving tray 18 in link motion with the rotation of upper cover 12*c* can be controlled and falling of sheets of paper P from paper receiving tray 18 caused by the rotation of upper cover 12*c* can be prevented. By doing this, at time of maintenance, the operation of removing once sheets of paper P on paper receiving tray 18 is not required, and the maintenance operation can be reduced, and sheets of paper P can be prevented from staining, and furthermore the space for the maintenance operation can be saved.

Next, the second embodiment of the present invention will be explained. The second embodiment is different from the first embodiment aforementioned in the mounting way of the paper receiving tray and in correspondence to it, also different in the movement of the paper receiving tray when the upper cover is opened and is the same as the first embodiment in the other respects. Therefore, in the second embodiment, to the same components as those explained in the first embodiment, the same numerals are assigned and the detailed explanation thereof will be omitted.

In this embodiment, document table 50 integrally incorporated in upper cover 12*c* of copier 48 is bendably formed on almost intermediate bent portion 50*a*.

Figure 5:
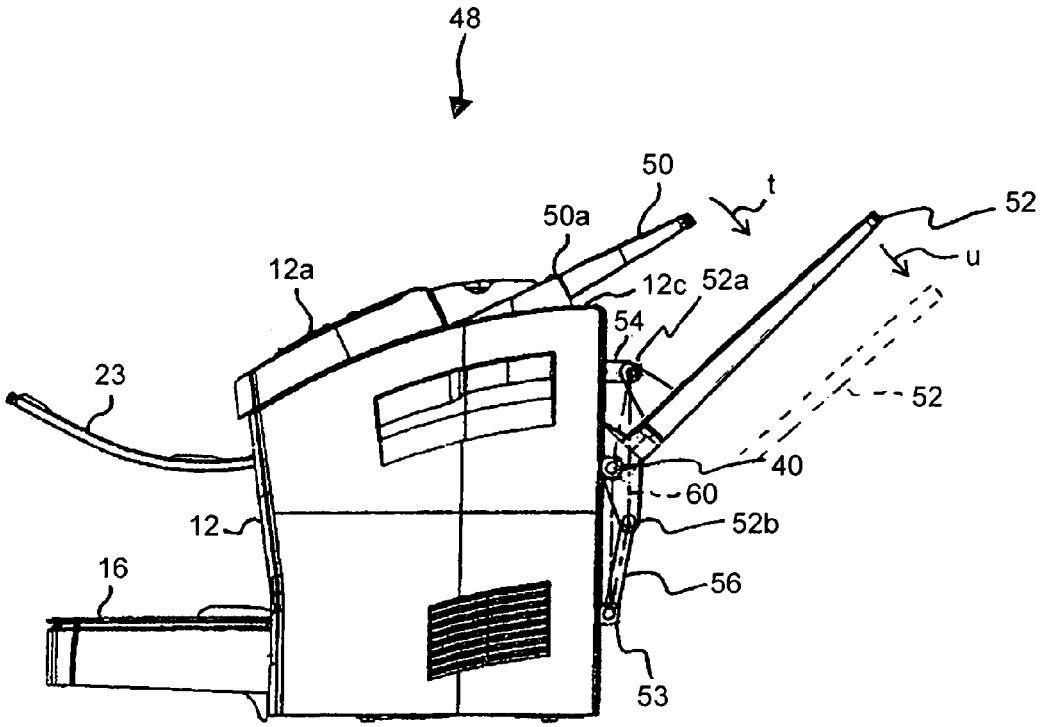
FIG. 5 is a schematic side view showing the copier, when the upper cover is closed, of the second embodiment of the present invention.

As shown in FIG. 5, paper receiving tray 52 has cover-side bracket 52*a* and link-side bracket 52*b*. Under switching support point 40 of frame side 12*b*, link support point 53 is installed. Cover-side bracket 52*a* of paper receiving tray 52 is rotatably attached to tray stop portion 54 projected from upper cover 12*c*. Link-side bracket 52*b* of paper receiving tray 52 is attached to link support point 53 via tray link 56 which is a link member.

Tray link 56 has a length almost equal to the distance from the position of switching support point 40 of upper cover 12*c* to the position of tray stop portion 54. Tray link 56 is rotatably attached to link support point 53 and link-side bracket 52*b* of paper receiving tray 52.

Figure 6:
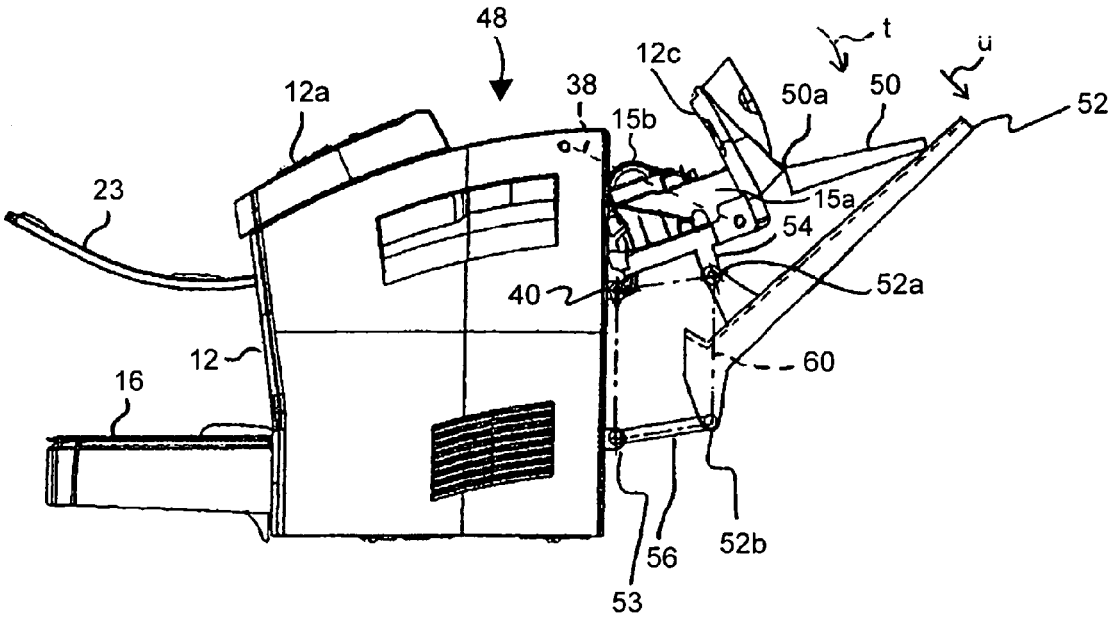
FIG. 6 is a schematic side view showing the copier, when the upper cover is opened, of the second embodiment of the present invention.

Therefore, at time of maintenance, as shown in FIG. 6, when upper cover 12*c* is rotated in the direction of arrow t at a fulcrum of switching support point 40, paper receiving tray 18 is supported by 10 upper cover 12*c* and tray link 56 and moves in parallel in the direction of arrow u. Namely, when upper cover 12*c* rotates in the direction of arrow t, a parallelogram 60 having vertexes of switching support point 40, tray stop portion 54, link-side bracket 52*b* of paper receiving tray 52, and link support point 53 and four sides of from link support point 53 to switching support point 40, from switching point 40 to tray stop portion 54, from tray stop portion 54 to link-side bracket 52*b* of paper receiving tray 52, and from link-side bracket 52*b* of paper receiving tray 52 to link support point 53 is formed as shown by a dotted line in FIG. 6.

Therefore, paper receiving tray 18 supported by tray stop portion 54 and link-side bracket 52*b* of paper receiving tray 52 moves in parallel in the direction of arrow u along the shape of parallelogram 60, so that although upper cover 12*c* rotates, paper receiving tray 52 does not rotate, and the inclination angle of sheets of paper P when loaded is kept. Hereafter, when chain 38 is stretched and upper cover 12*c* is stopped rotation, maintenance such as recovery of paper jamming is performed.

At this time, as shown in FIG. 6, upper cover 12*c* is rotated in the direction of arrow t at a sufficient angle to open body frame 12, while paper receiving tray 18 is not rotated and the inclination angle of sheets of paper P when loaded is kept. Therefore, sheets of paper P on paper receiving tray 18 are prevented from falling at time of maintenance.

Further, although upper cover 12*c* is rotated, paper receiving tray 52 does not rotate, so that as the rotational angle of upper cover 12*c* increases, document table 50 and paper receiving tray 18 interfere with each other and the front end of document table 50 makes contact with paper receiving tray 18. However, when document table 50 and paper receiving tray 18 interfere with each other, document table 50 bends at bent portion 50*a*, so that upper cover 12*c* is rotated smoothly free of resistance due to the interference between document table 50 and paper receiving tray 18.

After end of the maintenance, upper cover 12*c* is closed, and paper receiving tray 18 is returned to the position shown in FIG. 6, and the apparatus waits for the next image forming process.

According to the second embodiment, upper cover 12*c* is rotated at a large angle, thus the body frame is opened sufficiently and satisfactory maintainability can be obtained. On the other hand, although upper cover 12*c* is rotated, paper receiving tray 18 is moved in parallel but not rotated. Therefore, falling of sheets of paper P from paper receiving tray 18 caused by the rotation of upper cover 12*c* can be prevented. By doing this, at time of maintenance, the operation of removing once sheets of paper P on paper receiving tray 18 is not required, and the maintenance operation can be reduced, and sheets of paper P can be prevented from staining, and furthermore the space used for the maintenance operation can be saved.

Further, the present invention is not limited to the embodiments aforementioned and can be modified variously within the scope of the present invention. For example, the rotational angle of the cover member necessary for maintenance is not restricted and may be optionally set as required. Further, the constitution of the image forming apparatus is optional and for example, to supply a recording member to the image forming unit, a plurality of cassette units may be provided optionally or a recording member may be supplied manually. Furthermore, in the first embodiment, the inclination angle of the paper receiving tray controlled by the stopper member may be any value so long as a recording member does not fall and actually it may be 90° or less with the vertical direction.

As described above in detail, according to the present invention, although the cover member rotates for the body frame, the rotational angle of the paper receiving tray can be controlled or the paper receiving tray moves in parallel unless it is rotated. Therefore, during rotation of the cover member, the paper receiving tray can be prevented from inclination, thus a recording member can be prevented from falling, and during maintenance, there is no need to remove once the recording member on the paper receiving tray, and the maintenance operation can be reduced, and the recording member can be prevented from staining, and furthermore the space for the maintenance operation can be saved.

What is claimed is:

1. An image forming apparatus comprising:

a body frame having an image forming unit;

a cover member, which is openable and closable, provided on the body frame by rotating;

a paper receiving tray provided in the neighborhood of a side of the body frame, when the cover member is closed, so as to load a recording member which is formed with an image by the image forming unit and is discharged from the body frame; and a stopper member to fix the paper receiving tray, attaching slidably a mounting end to the cover member, making a free end thereof contact with the side of the body frame when the cover member is opened, and control an inclination angle of the paper receiving tray.

2. The image forming apparatus according to claim 1, wherein the stopper member is arranged in parallel with the side of the body frame when the cover member is closed and forms an angle with the side of the body frame when the cover member is opened.

3. The image forming apparatus according to claim 1, wherein the inclination angle of the paper receiving tray when the cover member is opened is 90° or less with the vertical direction.

4. The image forming apparatus according to claim 1, wherein the paper receiving tray is fixed between the mounting end of the stopper member and the free end.

5. The image forming apparatus according to claim 1, wherein the body frame has a document reader above the image forming unit and the cover member is opened and closed integrally with a document support member of the document reader.

6. The image forming apparatus according to claim 1, further comprising a cover control member to control a rotational angle of the cover member.

* * * * *